US011255152B2

(12) United States Patent
Johnson et al.

(10) Patent No.: US 11,255,152 B2
(45) Date of Patent: Feb. 22, 2022

(54) DRILL HOLE INNER TUBE PLUG

(71) Applicant: Hy-Tech Drilling Ltd, Smithers (CA)

(72) Inventors: Curtis Johnson, Smithers (CA); Mark Seilstad, Smithers (CA); Alex Christie, Smithers (CA)

( * ) Notice: Subject to any disclaimer, the term of this patent is extended or adjusted under 35 U.S.C. 154(b) by 0 days.

(21) Appl. No.: 16/616,286

(22) PCT Filed: May 22, 2018

(86) PCT No.: PCT/CA2018/000099
§ 371 (c)(1),
(2) Date: Nov. 22, 2019

(87) PCT Pub. No.: WO2018/213917
PCT Pub. Date: Nov. 29, 2018

(65) Prior Publication Data

US 2020/0224512 A1 Jul. 16, 2020

Related U.S. Application Data

(60) Provisional application No. 62/509,642, filed on May 22, 2017.

(51) Int. Cl.

| | |
|---|---|
| ***E21B 33/12*** | (2006.01) |
| ***E21B 33/138*** | (2006.01) |
| ***E21B 33/13*** | (2006.01) |
| ***E21B 33/16*** | (2006.01) |
| *E21B 33/14* | (2006.01) |

(52) U.S. Cl.
CPC ..... *E21B 33/1208* (2013.01); *E21B 33/138* (2013.01); *E21B 33/14* (2013.01)

(58) Field of Classification Search
CPC .... E21B 33/1208; E21B 33/13; E21B 33/138; E21B 33/16
See application file for complete search history.

(56) References Cited

U.S. PATENT DOCUMENTS

| | | | | |
|---|---|---|---|---|
| 2,978,029 A * | 4/1961 | True | E21B 23/065 166/63 |
| 3,760,877 A * | 9/1973 | De Lajarte | E21B 33/136 166/164 |
| 3,776,250 A * | 12/1973 | Knox | E21B 21/10 137/71 |
| 2014/0238694 A1* | 8/2014 | Fraser | E21B 33/13 166/382 |

* cited by examiner

*Primary Examiner* — Catherine Loikith
(74) *Attorney, Agent, or Firm* — Island IP Law; Stephen R. Burri

(57) ABSTRACT

An inner tube plug for plugging a diamond drill hole. The plug assembly comprises a compressible plunger component attached to one end of a body component, plug feet radially disposed around the body component, and a torsion spring disposed between pairs of adjacent plug feet. The inner tube plug is used to perform down-hole orientation correction of a drill bole, zone bypassing, and completion of a drill hole.

7 Claims, 4 Drawing Sheets

DRILL HOLE INNER TUBE PLUG

FIELD OF THE INVENTION

The present invention relates to industrial drilling. In particular, the invention relates to drill hole plugs for use in diamond drilling.

BACKGROUND OF THE INVENTION

Prior art drill hole plugs are readily available in the diamond drilling industry and are known as "Van Ruth Plugs". They are used for bridging off (or 'plugging') a hole at a selected depth. There is a requirement to bridge the hole whenever a wedge is being installed off the bottom of the hole or whenever a cement job must be performed off the bottom of the hole. On most holes drilled, the hole must be capped with a cement plug. Such capping requires firstly the installation of a Van Ruth plug, followed by the pumping of cement on top of the Van Ruth plug.

To install a Van Ruth Plug in any hole, the first thing required is to pull out all of the drill rods from the hole, remove the complete core barrel assembly from the bottom end of the drill rods, and install a rod shoe on the end of the rods. This is required because the Van Ruth plug will not fit through the core barrel assembly.

The rods then must be tripped back into the hole to the desired depth and be suspended there. Next, a Van Ruth plug is installed in the top of the rods and it is pumped down the rods. When it reaches the rod shoe at the end of rods, it pops out of the rods, expands, and locks in place. At this point drill operators can proceed with the next step either of performing a cement job or tripping out the drill rods again, possibly to install a wedge.

According to prior art methods, when a wedge is required to correct the orientation of the drill hole or to re-route the drill hole around an impassable zone, traditionally the following steps are required:

1. Pull all the rods out of the hole (sometimes this takes upwards of 12 hours).
2. Remove the complete inner and outer core barrel assemblies from the rod string and replace with a shoe.
3. Re-enter the hole with the shoe installed and proceed adding rods until you reach the desired depth to deviate the hole.
4. Pump the traditional plug through the shoe (at this point the plug will expand to hole size, blocking the hole).
5. Pump epoxy bag or cement down the hole, through the center of the rod string, until it hits the plug.
6. Pull entire rod string out of the hole (at this stage the plug and epoxy/cement remain at the desired deviation depth).
7. Attach wedge to bottom of the rod string and re-enter the hole. Set azimuth, and then plunge the wedge into the epoxy, breaking the connection between the rods and the wedge.
8. Remove rod string.
9. Re-install drill bit, lower to wedge, and commence drilling.

Holes are drilled up to 2000 meters deep, but most commonly to a depth of 800-1000 meters. When drill rods must be pulled out to remove the core barrel, put on a rod shoe, and then trip the rods all the way back down to the bottom of the hole. For a 1000-meter hole, this may take approximately eight hours.

It is desirable to develop a drill hole plug which permits a plugging procedure requiring less time, and which causes less wear on drilling equipment.

SUMMARY OF THE INVENTION

There is provided a plug for plugging a diamond drill hole, the plug assembly comprising a body component having proximal and distal ends; a compressible plunger component attached to the distal end of the body component by attachment means; a plurality of plug feet disposed radially around the body component; and a torsion spring disposed between each pair of adjacent plug feet.

There may be four plug feet. The attachment means may be external threads on the distal end of the body and corresponding internal threads on the plunger component.

The plunger may be manufactured of a spongy cellular material and may be encased in a resilient material selected from the group of materials comprising urethane and rubber. The plug feet may be manufactured of a cast zinc alloy.

The plug feet may be transitionable between a compressed delivery position encircling the proximal end of the body component inside an inner core tube, and an expanded plugging position encircling a medial portion of the body component external to the inner core tube.

There is further provided a method of performing a down-hole orientation correction of a drill hole during diamond drilling comprising the steps of retracting the inner tube from the drill hole using a wireline winch; loading the plug of claim 1 into the end of the inner tube; delivering the inner tube and plug assembly down-hole to a desired deviation depth; pumping water down the hole to expel the plug from the inner tube; pumping an epoxy bag down the hole, through the center of the rod string, until it hits the plug; extracting the rod string from the hole, leaving the plug and epoxy at the desired deviation depth; attaching a wedge to the bottom of the rod string and re-inserting the rod string into the hole; setting the azimuth and plunging the wedge into the epoxy, breaking the connection between the rod string and the wedge; removing the rod string; re-installing the drill bit and lowering it to the wedge; and commencing drilling.

There is further provided a method of bypassing an impassable zone during diamond drilling, comprising the steps of retracting the inner tube from the drill hole using a wireline winch; loading the plug of claim 1 into the end of the inner tube; delivering the inner tube and plug assembly down-hole to a desired depth above the impassable zone; pumping water down the hole to expel the plug from the inner tube; pumping an epoxy bag down the hole, through the center of the rod string, until it hits the plug; extracting the rod string from the hole, leaving the plug and epoxy at the desired deviation depth; attaching a wedge to the bottom of the rod string and re-inserting the rod string into the hole; setting the azimuth and plunging the wedge into the epoxy, breaking the connection between the rod string and the wedge; removing the rod string; re-installing the drill bit and lowering it to the wedge; and commencing drilling.

There is further provided a method of completing a drill hole during diamond drilling, comprising the steps of retracting the inner tube from the drill hole using a wireline winch; loading the plug of claim 1 into the end of the inner tube; delivering the inner tube and plug assembly down-hole to the bottom of the hole; pumping water down the hole to expel the plug from the inner tube; and pumping concrete down the hole onto the plug to seal off the hole.

DETAILED DESCRIPTION OF THE DRAWINGS

It is to be expressly understood that the description and drawings are only for the purpose of illustration and as an aid to understanding, which are not intended as a definition of the limits of the invention. In the accompanying drawings, alternate embodiments of the invention are shown by way of example only, in which.

and

Figure 12:
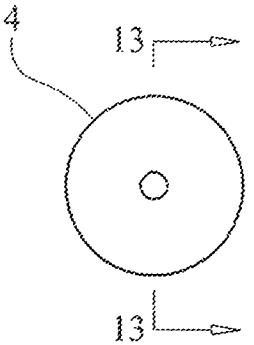
FIG. 12 is a bottom plan view of the first embodiment of the body of the plug of the invention.
Figure 13:
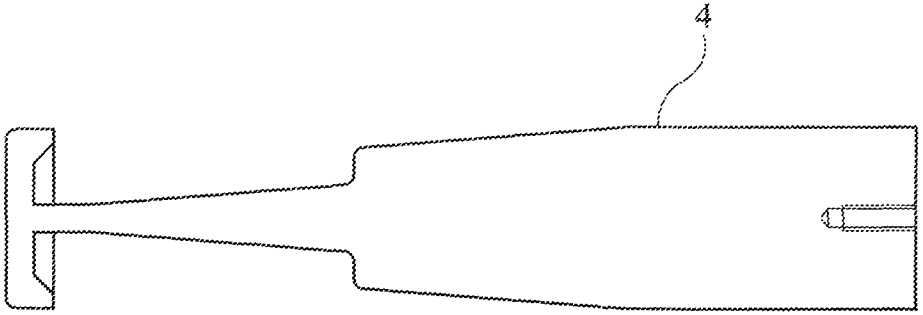

FIG. 13 is a cross-sectional view of the body of the plug through 13—13 of FIG. 12.

DESCRIPTION OF THE INVENTION

As shown in the drawings, the plug of the present invention consists of 6 components, including the compressible plunger 2 which attaches to the main body 4 by threading on at the time of use. The main body houses the four plug feet 6 that are compressed into the reduced diameter and have a small torsion spring 8 between each adjacent pair of plug feet. The plunger preferably is manufactured of a dual density integral skin urethane foam.

Figure 1:
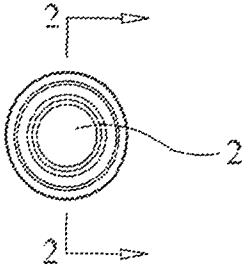
FIG. 1 is a bottom plan view of a first embodiment of the plug and inner tube assembly of the invention with the plug in a compressed position inside the inner tube.
Figure 2:
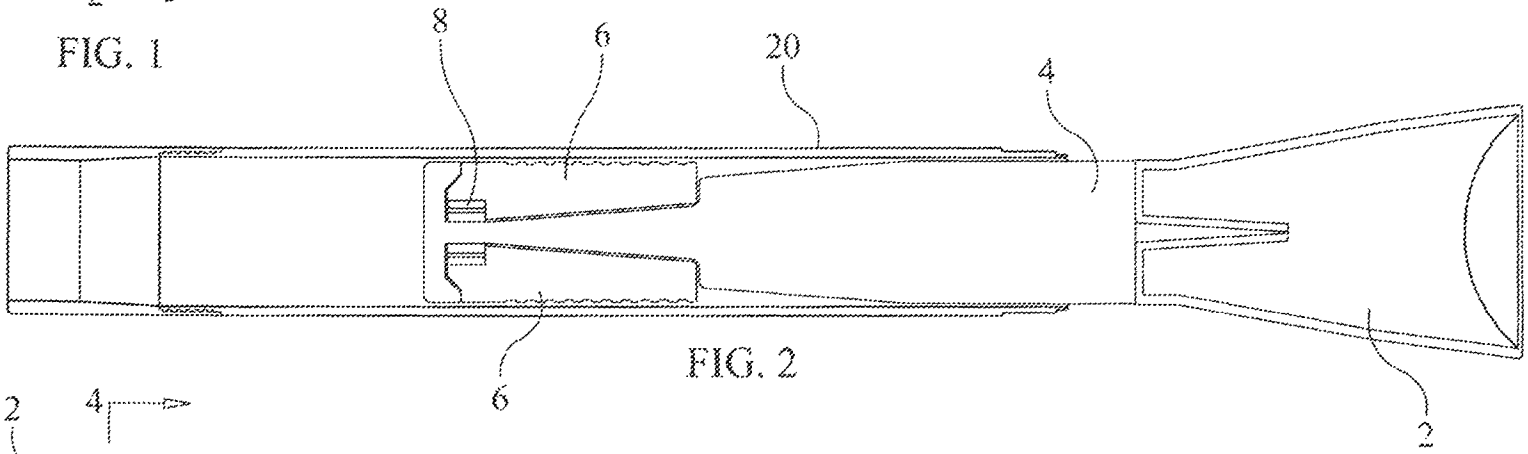
FIG. 2 is a cross-sectional view through 2—2 of FIG. 1 showing the plug of the invention loaded inside the end of an inner tube.
Figure 3:
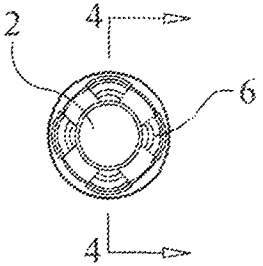
FIG. 3 is a bottom plan view of a first embodiment of the plug in an expanded position within the drill hole.
Figure 4:
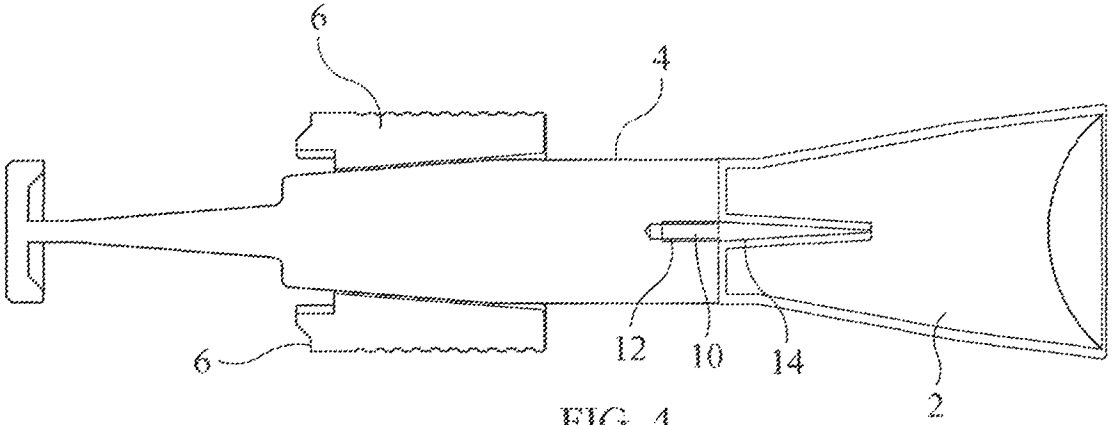
FIG. 4 is a cross-sectional view through 4—4 of FIG. 3 showing the plug of the invention expanded within the drill hole.
Figure 6:
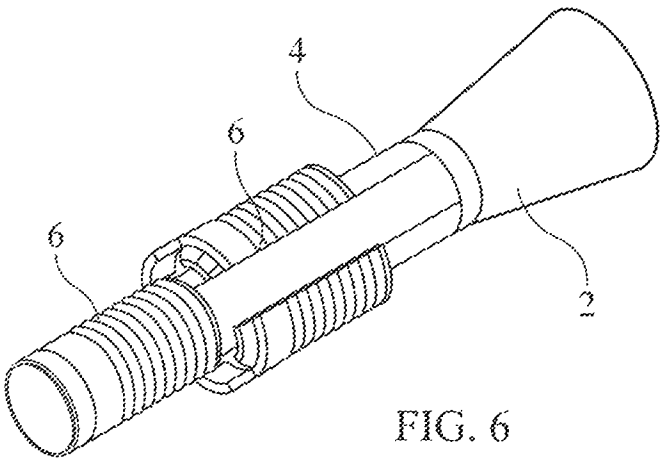
FIG. 6 is a perspective view of the composite of FIGS. 5A and 5B.
Figure 5A:
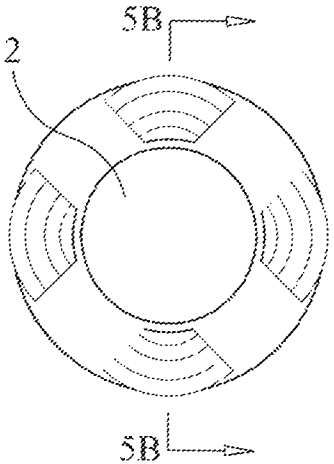
FIG. 5A is a composite end plan view of FIGS. 1 and 3 for an alternate preferred second embodiment of the invention depicting the change in position of the plug feet between the compressed and expanded plug positions.
Figure 5B:
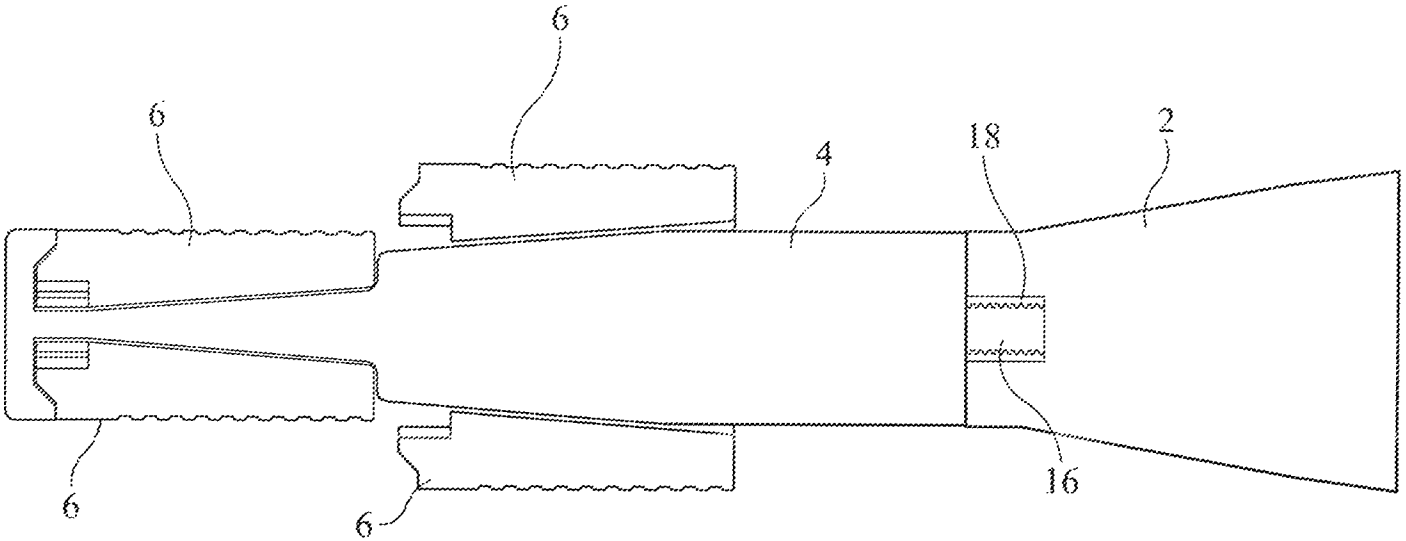
FIG. 5B is a composite cross-sectional view of FIGS. 1 and 3 through 5B—5B of FIG. 5A.
Figure 8:
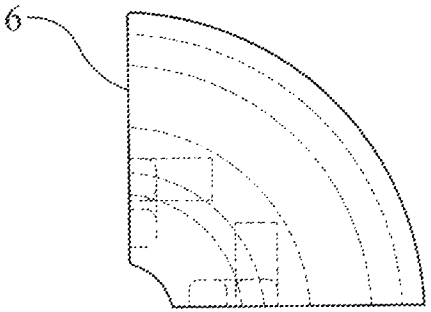
FIG. 8 is a horizontal cross-sectional view of a plug foot.
Figure 7:
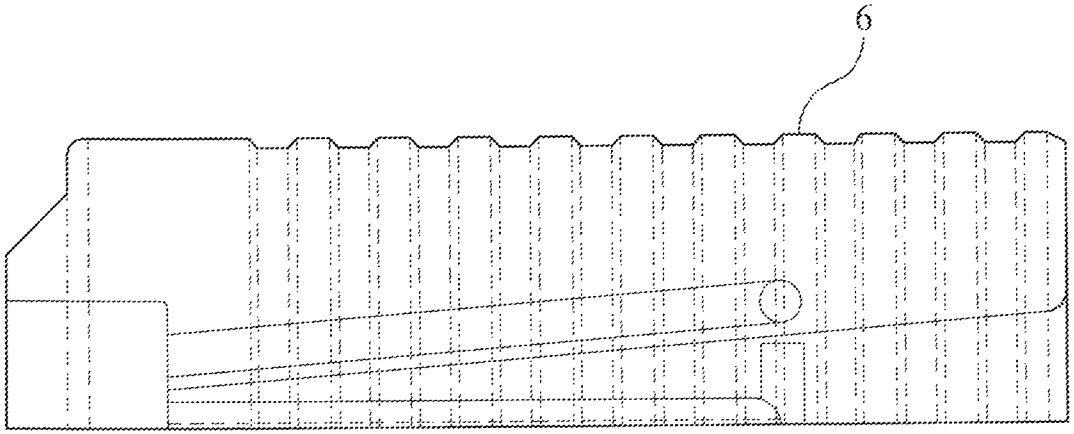
FIG. 7 is a longitudinal cross-sectional view of a plug foot.
Figure 9:
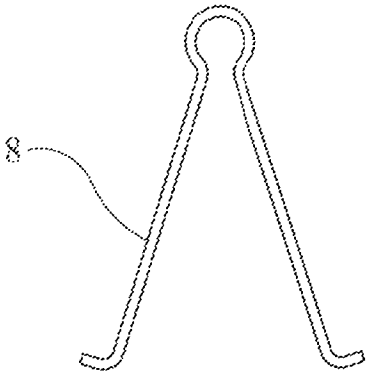
FIG. 9 is a plan view of a torsion spring.
Figure 10:
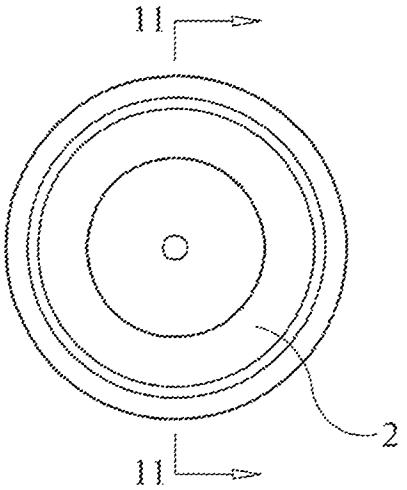
FIG. 10 is a bottom plan view of the first embodiment of the plunger of the invention.
Figure 11:
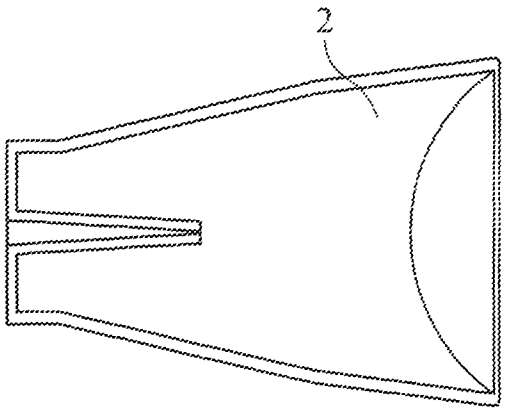
FIG. 11 is a cross-sectional view of the plunger through 11—11 of FIG. 10.

According to a first embodiment, the plunger and body of the plug may be attached by a dowel 10 glued into corresponding openings 12, 14 in the distal end of the body and the proximal end of the plunger. In a preferred embodiment shown in FIGS. 5A, 5B, and 6, an externally threaded projection 16 on the distal end of the body is threadable with an internally threaded receptacle 18 in the proximal end of the plunger.

The plug of the present invention can be loaded inside of an inner core tube 20 before being pumped down the drill hole and ejected out the end of the core barrel without having to pull the drill rods out of the hole.

This operation may require only 45 minutes for a drill hole 1000 meters deep. This is a very significant reduction in time and eliminates the wear and tear on the drill rod threads. By not having to make and break the joints, the wear and tear on the drill operators pulling the rods is eliminated, as is the risk associated with tripping "open" rods into the drill hole with only the rod shoe in place.

The drill hole plug of the present invention was developed with the primary purpose of eliminating "rod tripping" when needing to install a bridging style plug. As the plug of the present invention has a diameter sufficiently small as to fit within the inside of the inner core tube, there is no need to remove the core barrel assembly from the end of the drill rods and to install a rod shoe on the end of the drill rods.

Where a diamond drilling service involves lining up the drill and mast on surface to intersect a target at a specific depth and orientation, it may sometimes be necessary to re-orient the drill hole. If the hole deviates from the predicted path, a down-hole orientation correction will be performed by installing a wedge at specific position and orientation to re-direct the hole back on target. When installing a steel wedge, using prior art methods it is necessary to perform up to 4 complete cycles of pulling all the drill rods out of the hole and putting them back in the hole. With the Inner Tube Plug Assembly and method of the present invention, one of these rod-pulling cycles may be eliminated completely. As the drill holes get deeper the amount of time required to perform one complete rod pulling cycle can be anywhere from 6-12 hours, increasing the benefit of the present invention over the prior art.

The other diamond drilling procedures that will benefit from the Inner Tube Plug of the present invention include situations where an impassable zone of rock is encountered that prevents the hole advancement. In these instances, the drill rods can be pulled back to a position higher up the hole and install an Inner Tube Plug and wedge to bypass this zone, eliminating one complete rod pulling cycle from this procedure as well.

Normally when drill holes are completed to depth, there is a hole completion procedure that will involve the placement of a plug in the hole and then adding a batch of cement on top of the plug to seal off the hole. This procedure will also benefit from the use of the Inner Tube Plug by the elimination of the rod pulling cycle to complete this event.

The inner tube and plug assembly of the present invention reduces the number of rod pulls required for setting a wedge, saving on time, fuel, people, and rod thread wear.

The method of deployment of the plug of the present invention comprises the following steps:

1. Retract inner tube with wireline winch and install inner tube and plug assembly.
2. Pump water down the hole to deploy plug.
3. Pump epoxy bag down the hole, through the center of the rod string, until it hits the plug.
4. Pull entire rod string out of the hole, leaving the plug and epoxy at the desired deviation depth.
5. Attach wedge to bottom of the rod string and re-enter the hole. Set azimuth, and then plunge the wedge into the epoxy, breaking the connection between the rods and the wedge.
6. Remove rod string.
7. Re-install drill bit, lower to wedge, and commence drilling.

The inner tube drill plug apparatus and methods of the present invention are designed particularly for diamond drilling operations but use in other drilling operations may be possible with appropriate size customization.

It will be appreciated by those skilled in the art that other variations of the preferred embodiment may also be practiced without departing from the scope of the invention.

The invention claimed is:

1. A plug for plugging a diamond drill hole, the plug assembly comprising:

a body component having proximal and distal ends;

a compressible plunger component attached to the distal end of the body component by attachment means;

a plurality of plug feet disposed radially around the body component; and a torsion spring disposed between each pair of adjacent plug feet;

wherein the plunger is manufactured of a spongy cellular material and is encased in a resilient material selected from the group of materials comprising urethane and rubber.

2. The plug of claim 1, wherein the plurality of plug feet comprises four plug feet.

3. The plug of claim 1, wherein the attachment means comprises external threads on the distal end of the body and corresponding internal threads on the plunger component.

4. The plug of claim 1, wherein each of the plug feet is manufactured of a cast zinc alloy.

5. The plug of claim 1, wherein the plurality of plug feet is transitionable between a compressed delivery position encircling the proximal end of the both component inside an inner core tube, and an expanded plugging position encircling a medial portion of the body component external to the inner core tube.

6. A method of performing a down-hole orientation correction of a drill hole during diamond drilling comprising the steps of:

a. retracting an inner core tube from the drill hole using a wireline winch;

b. loading the plug of claim 1 into an end of the inner core tube;

c. delivering the inner core tube and plug assembly down-hole to a desired deviation depth;

d. pumping water down the hole to expel the plug from the inner core tube;

e. pumping an epoxy bag down the hole, through a center of a rod string, until it hits the plug;

f. extracting the rod string from the hole, leaving the plug and epoxy at the desired deviation depth;

g. attaching a wedge to a bottom of the rod string and re-inserting the rod string into the hole;

h. setting an azimuth and plunging the wedge into the epoxy, breaking the connection between the rod string and the wedge;

i. removing the rod string;

j. re-installing a drill bit and lowering it to the wedge; and k. commencing drilling.

7. A method of bypassing an impassable zone during diamond drilling, comprising the steps of:

a. retracting an inner core tube from a drill hole using a wireline winch;

b. loading the plug of claim 1 into an end of the inner core tube;

c. delivering the inner core tube and plug assembly down-hole to a desired depth above the impassable zone;

d. pumping water down the hole to expel the plug from the inner core tube;

e. pumping an epoxy bag down the hole, through a center of a rod string, until it hits the plug;

f. extracting the rod string from the hole, leaving the plug and epoxy at the desired deviation depth;

g. attaching a wedge to a bottom of the rod string and re-inserting the rod string into the hole;

h. setting an azimuth and plunging the wedge into the epoxy, breaking the connection between the rod string and the wedge;

i. removing the rod string;

j. re-installing a drill bit and lowering it to the wedge; and k. commencing drilling.

* * * * *